US005503100A

United States Patent [19]

Shaw

[11] Patent Number: 5,503,100

[45] Date of Patent: Apr. 2, 1996

[54] HYBRID WATER VESSELS

[76] Inventor: Clifford C. C. Shaw, 7318 Fairchild Dr., Alexandria, Va. 22306

[21] Appl. No.: 239,686

[22] Filed: May 9, 1994

[51] Int. Cl.[6] ..... B63B 1/24

[52] U.S. Cl. ..... 114/274; 114/56; 114/271

[58] Field of Search ..... 114/56, 57, 59, 114/61, 121, 125, 271, 274, 280, 282, 284, 292, 283

[56] References Cited

U.S. PATENT DOCUMENTS

| | | | |
|---|---|---|---|
| 3,730,123 | 5/1973 | Lang | 114/280 |
| 4,040,373 | 8/1977 | Jones, Jr. | 114/280 |
| 4,434,737 | 3/1984 | Weiss | 114/271 |
| 4,843,993 | 7/1989 | Martin | 114/125 |

FOREIGN PATENT DOCUMENTS

| | | | |
|---|---|---|---|
| 2410004 | 1/1975 | Germany | 114/280 |
| 149606 | 9/1931 | Switzerland | 114/274 |

*Primary Examiner*—Edwin L. Swinehart

[57] ABSTRACT

A hybrid high performance water vessel consists of two hulls: an upper hull with a pair of main fluid-lifting-plane means (called mainfoils thereafter), for providing hydrodynamic lifting force at high speed; and a torpedo shaped streamlined sub-hull disposed beneath the water line, for providing the majority of flotation. Along the water line is a knife-like slender hull called mainstrut that pierces through water surface to minimize the crucial wave-making resistance. The mainfoils are located close to one end section of the vessel, and the sub-hull is placed at the other end section of the vessel, so that the center of hydrodynamic lifting force of the mainfoils and the center of buoyancy of the water vessel is offset substantially along the longitudinal axis of the vessel system. It enables the water vessel of present invention to have a "Hull Inclination" capability that improves the performances of said water vessels. At high speed, the vessel of present invention will incline in a longitudinal direction such that the sub-hull submerges into water and the upper hull is lifted and held above the surface of water. The mainfoils also provide rolling control and substantial pitching control at high speed. When operating in a shallow or an unfamiliar water way with low speed, said vessel will incline longitudinally in an opposite direction, such that the sub-hull is raised up and close to the water surface for reducing the draught.

8 Claims, 14 Drawing Sheets

HYBRID WATER VESSELS

BACKGROUND REFERENCES

1. Proceedings magazine, April 1991, page 34, "Exploiting Defense Technology After the cold war", by John R, Meyer, Jr., David Taylor Research Center (DTRC).

2. U.S. Pat. No. 4,819,576 "Hydrofoil-submarine vessel systems", by Chung Chen, Shaw (myself), dated Apr. 11, 1989, now abandoned.

BACKGROUND OF THE INVENTION

This is an aggressive improvement to my last U.S. Pat. No. 4,819,576 "Hydrofoil-Submarine Vessel Systems".

It is well known in naval architecture that the speed of a displacement type surface ship is greatly limited by wave formation and resistance resulting from these waves. As the speed of a ship increases, its Froude number increase. This number is a relationship dependent upon ship's speed. At a Froude number of 0.5 and greater, wave resistance increases at a very rapid rate. This phenomenon limits the speed of a displacement type surface ship to a maximum Froude number of about 1.3.

It is also well known in naval architecture that the wave formation by a conventional displacement type surface ship moving at a reasonable high speed occurs at the interface of water and air. So the most successful approaches to reduce resistance are almost exclusively in reducing or near eliminating wave-making resistance. This is accomplished by either rising above the static flotation level or out of the water entirely to reduce the amount of displacement volume at the interface of the water and air (such as hydrofoil craft), or, on the other hand submerging beneath the water's surface to reduce or eliminate the energy absorbed in wave formation (such as submarine).

A hydrofoil craft lifts its hull above the water surface by the hydrodynamic lift of underwater wings or hydrofoils. This type of dynamic support provides a greater reduction in resistance and is superior in rough-water performance when compared to both planing and displacement hulls in the same speed range. On the other hand, a submarine operating at a depth below the surface of 3 times the diameter of the hull or greater, experiences a negligibly wave resistance; nearly all of its resistance being frictional and eddy making resistance. It eliminates a crucially important limitation to the speed experienced by all the conventional surface ships. Since the wave making resistance of a submarine increases with speed at a much lower rate. Therefore, the top speed of a submerged submarine is potentially much higher than that of the displacement surface ship of the same length and immersed volume.

Although "Hydrofoil" and "submarine" overcome the resistance-drag of ships' wave-making phenomena, there are still problems which limit the applications of these types of crafts.

For hydrofoil craft, it is well known in naval architecture that the tonnage of a hydrofoil type craft is limited currently to about 400 tons, because the weight increase of a hydrofoil craft is much faster than the lifting force of the foils when the dimensions of the vessel are increased. In fact the tonnage increases cubically with its dimensions while the lifting force of the hydrofoil increases squarely with its dimensions.

It is also well known that the power transmission system of a retractable hydrofoil craft is very complicated and often causes maintenance and operational problems resulting from many delicate moving elements enclosed in the movable spidery struts. It is also very inconvenient for a fixed hydrofoil craft to rest at a limited depth of harbor, because the extension of foil planes may hit the bed of the harbor, especially for a large tonnage vessel with long and deep fixed foils.

On the other hand, a submarine has complications which make it the most expensive type of craft to build, most complicated type to operate and most uncomfortable type of ship to ride. These limit its application on commercial services.

Reference 1 shows a US-navy-developed hybrid hydrofoil craft, which provides considerable potential over current small monohulls and conventional hydrofoils in terms of maximum speed, motions in rough water, and range at high speed. Since the large wings or hydrofoils are fixed to the sub-hull and always buried deeply into water, obviously, it will has the same disadvantages as the conventional fixed hydrofoil crafts have.

My last invention (U.S. Pat. No. 4,819,576), provides two designs for high speed sea vessel systems, with the possibility of having a large tonnage as a submarine and the characteristics of cruising stability, operational flexibility and comfortability as a retractable foil type hydrofoil craft. Still there are two potential disadvantages: the first embodiment of my last invention makes the vessel system with two separated crafts and connected by a universal joint; the second embodiment of my last invention makes the vessel systems with two hulls and connected by rotatable links. Structurally, the joint and links are the weak points. Integration between the two separated crafts or hulls is also inconvenience. The fabrication and operation costs for these designs will be too high for military and commercial applications.

It is therefore an object of the present invention to provide innovatory hull forms and means for high speed water vessels. The water vessels of this invention will have much simpler and stronger structures; in turn they will have much lower fabrication and operation costs. They eliminate all the problems of my last invention, and in the meantime, allow a large tonnage as a submarine, and have the advantages of cruising stability, operational flexibility and comfortability as a retractable foil type hydrofoil craft.

From basic trigonometry (see FIG. 27 and 28), a horizontal bar BR with length 2LN, to be inclined in a longitudinal direction against the center of gravity GC with an angle A, the vertical displacements at both ends are V=LN*sinA. When the LN is large, a small amount of inclined angle A may generate a some good amount of V. Let's apply this phenomenon to a ship by embedding a bulb (or sub-hull 2, refer to FIG. 28 and FIG. 1) at one end, and widening the other end to become upper hull. Propeller 8 and foils 9 are adapted at suitable places. The "inclined bar" becomes a hybrid hydrofoil craft with varied characteristics. FIG. 28 shows that V is the upper hull's "flying" height, and −V is the depth of the sub-hull diving. It should be noted that when the angle A approaches to zero, V and −V disappeared; implying that the draught of this craft will be much reduced when the hull (or bar) inclined toward to the other direction.

Therefore, the other objects of this invention are: to disclose the unique "Hull Inclination Methods" (by using said "Inclined Bar Phenomenon") for a ship; and to disclose new ship structures and means to apply said "Hull Inclination Methods", for improving operational performances.

SUMMARY OF THE INVENTION

This invention discloses structures and means for the different types of displacement-foiled hybrid water vessels in a variety of configurations.

The basic structure of water vessel of present invention consists of: an upper hull with mainfoils mounted at one end, and a sub-hull placed at other end of the vessel and disposed beneath the water line. Along the water line is a slender mainstrut. The sub-hull and mainstrut together is called lower-hull. When running at high speed, the center of hydrodynamic forces of the mainfoils and the center of buoyancy of said lower-hull is offset substantially along the longitudinal axis of the vessel. The mainfoils provide substantial rolling, pitching controls, and partial lifting support. The remaining lifting contributed by the buoyancy of said lower-hull.

The first and second embodiments of present invention are the combinations of a submarine and a hydrofoil craft with the mainfoils mounted at stern end. The second embodiment is for a small craft using a tiltable stern drive unit.

The third embodiment is a combination of a rowing shell and a hydrofoil craft, with the mainfoils means mounted at bow end.

The fourth embodiment is a combination of a submarine and hydrofoil craft with the propeller means located at bow section. Three different designs are provided for bow propeller protection. The fifth embodiment is a combination of a submarine and a planing boat. Said planing boat is located at bow end of the vessel system. This design is simple, strong and for low cost.

BRIEF DESCRIPTION OF THE DRAWINGS

All drawings provided here in this literature are somewhat schematic and wherein the like reference characters like parts in all views and drawings:

FIG. 1 is a side elevational view of the first preferred embodiment of this invention while the vessel is at high cruising speed.

FIG. 2 is the V1–V1' section view of FIG. 1.

FIG. 3 is the top view of FIG. 1, drawing shown the portion above the water line only.

FIG. 4 is the stern view of FIG. 1.

FIG. 5 is the bow view of FIG. 1.

FIG. 6 is a side elevational view of the vessel when the vessel is cruising at low speed.

FIG. 7 is a side elevational view of the vessel while the vessel is resting on a harbor with all foils retracted.

FIG. 8 is a side elevational view of an alternate design of the first embodiment. This vessel has a single propeller.

FIG. 11 is a side elevational view of the third preferred embodiment of this invention when the vessel is at high cruising speed.

FIG. 12 is the top view of FIG. 11.

FIG. 13 is the V4–V4' section view of FIG. 11.

FIG. 14 is the bow view of FIG. 11.

FIG. 15 is a side elevational view of the fourth preferred embodiment of this invention when the vessel is at high cruising speed.

FIG. 16 is the top view of FIG. 15. Drawing shows the portion above the water line only.

FIG. 17 is the V2–V2' section view of FIG. 15.

FIG. 18 is a side elevational view of the vessel when the vessel is going backward at low speed.

FIG. 19 is a partial top view (at the bow end) of an alternate design of the fourth embodiment.

FIG. 20 is the side view of FIG. 19.

FIG. 21 is a side elevational view of another alternate design of the fourth embodiment.

FIG. 22 is the partial bow elevational view of FIG. 21.

FIG. 23 is the top elevational view of FIG. 21 with the foils vertically retracted.

NAMES AND THE CORRESPONDING REFERENCE NUMBERS AND/OR CHARACTERS

| NO. | NAME/DESCRIPTION |
|---|---|
| 1 | Central body, upper hull |
| 2 | Sub-hull |
| 3 | Mainstrut |
| 4 | Stabilizer/outrigger |
| 5 | Deck |
| 6 | Bridge |
| 6' | Backward pilot-house |
| 7 | Fore Propeller |
| 8 | Propeller |
| 81 | Tiltable drive unit |
| 9 | Mainfoils |
| 10 | Auxiliary foil |
| 11 | Planing flap |
| 12 | Fore rudder |
| 13 | Pivot, foil-strut |
| 14 | Bow visor |
| 15 | Second stage sub-hull |
| 16 | Bow, sub-hull |
| 17 | Sub-door |
| 18 | Retractable strut, mainfoils |
| 19 | V bottom, central body |
| 20 | Auxiliary propeller |
| 21 | Side thruster |
| 22 | Planing surface |
| 23 | Funnel |
| 24 | Ballast tank, aft |
| 25 | Stern rudder |
| 31 | Inlet, Water jet |
| 32 | Vectored nozzle, Water jet |
| 33' | Retractable PP (propeller protector)/rudder bi-functional means, (lowered down position) |
| 33 | Retractable PP/rudder (swung up position) |
| 34 | Lock pin |
| 35 | Pivot, PP |
| 36 | Flap |
| 37 | Support bar (upper position) |
| 37' | Support bar (lower position) |
| 40 | V bottom, stabilizer |
| 91 | Mainfoils, fixed |

-continued

Figure 14:
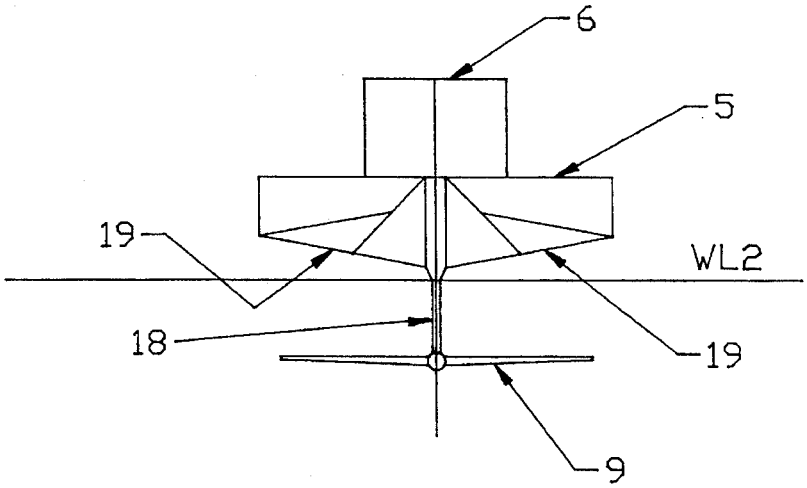

| NO. | NAME/DESCRIPTION |
|---|---|
| A1 | Angle of attack of mainfoils, Cruising |
| A2 | Angle of attack of mainfoils, before takeoff |
| A3 | Upper hull level angle, cruising |
| A4 | Upper hull level angle, low speed |
| A5 | Upper hull level angle, at rest |
| D1 | Draught, cruising |
| D2 | Draught, at rest |
| D3 | Draught, low speed or at rest in deep water |
| BW | Go backward direction, at low speed, in FIG. 14 |
| FW | Go forward direction, at cruising |
| H1 | Upper hull |
| H2 | Lower-hull (including mainstrut and sub-hull) |
| S1 | Horizontal distance 1, "p" to "L" |
| S2 | Horizontal distance 2, "P" to "B" |
| B | Buoyancy of lower-hull |
| P | Gross weight of water vessel |
| L | Lifting force of mainfoils |
| WL0 | Water line, resting/docking |
| WL1 | Water line, low speed |
| WL2 | Water line, cruising |
| WL3 | Water line, at low speed or rest in deep water |
| WLC | Hydrodynamic center line of sub-hull |

DETAILED DESCRIPTIONS OF THE PREFERRED EMBODIMENTS

Referring to FIG. 1 to FIG. 7, the first preferred embodiment of this invention basically is a hydrofoil craft (upper hull H1) with a central body 1 that rides and is fixed on the stern top of a submarine (two stages hull, sub-hull 2 and 15), and said two crafts are connected by a slender mainstrut 3. On the upper hull, two stabilizers 4 and wing like wide decks 5 (in FIG. 3) are disposed to both the port and starboard sides of the central body 1. A pair of retractable mainfoils 9 installed at the stern end of the central body 1. A pair of auxiliary foils 10, which are not absolutely necessary but in most cases they help for pitching control, are installed to the both sides of said sub-hull. Two main propellers 8, which generate pushing forces at high speed, are installed at the aft end of said sub-hull 2, and is located approximately at the midship of the whole system. Besides a stern rudder 25, a fore rudder 12 is adapted for improving yawing control and maneuverability.

Figure 3:
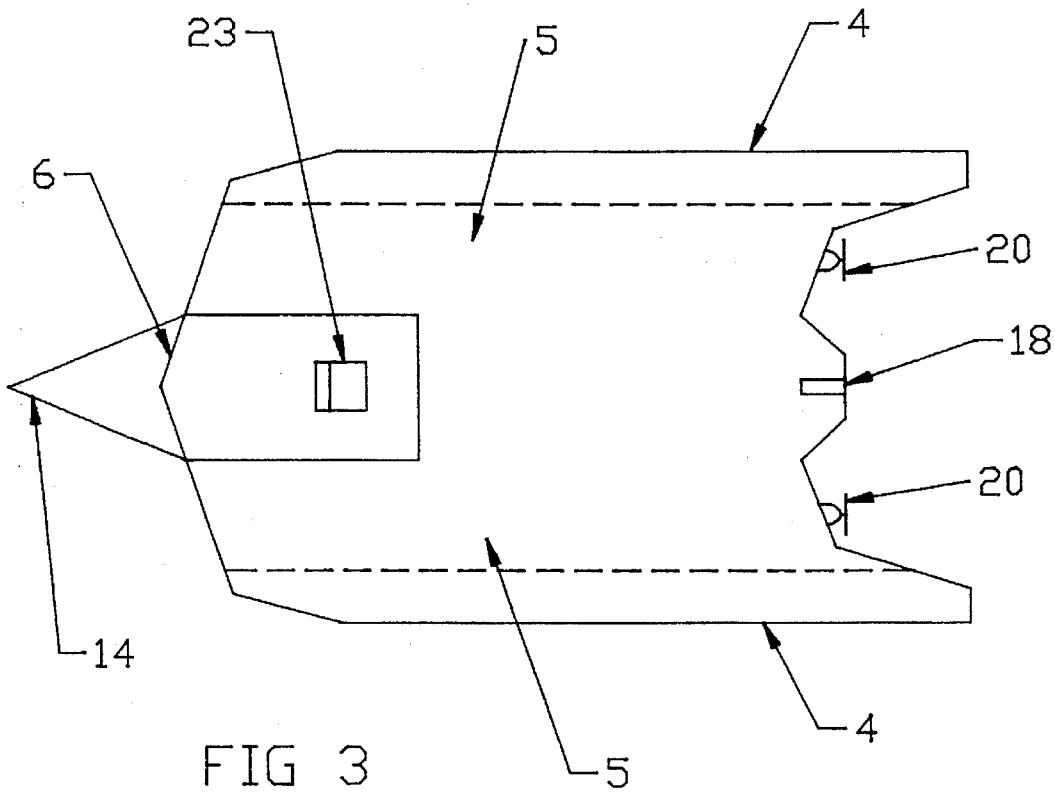

All the heavy stuff and equipment such as machinery, fuel or liquid cargo, partial of military payload are located and stocked in the sub-hull 2. Passengers, crew, controls, communication equipment and some military payload are located in the upper hull H1. The structures of surface portion (the upper hull H1) shown in FIG. 3 are made of light and high strength material such as fiber reinforced plastic (FRP) or aluminum alloy. The sub-hull 2 has an ellipse cross section (shown in FIG 5) for increasing the buoyancy.

Figure 1:
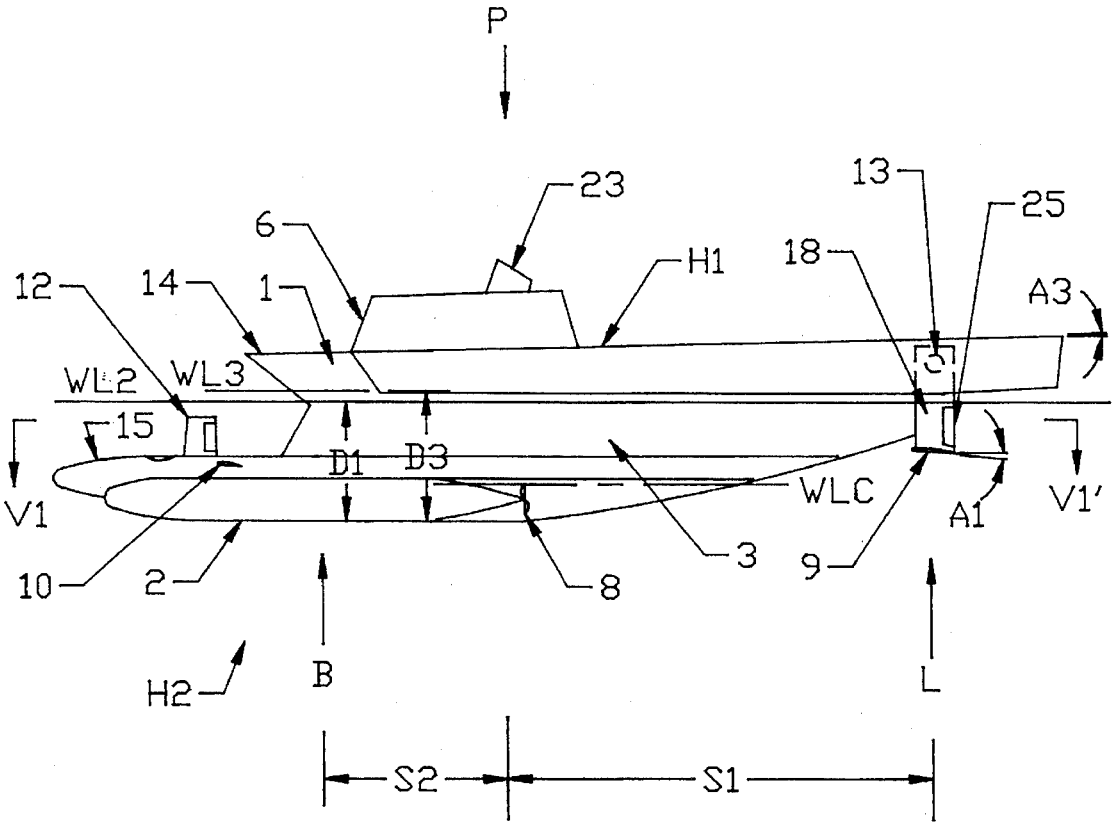
FIG. 1 through 8 are views of the first preferred embodiment.
Figure 2:
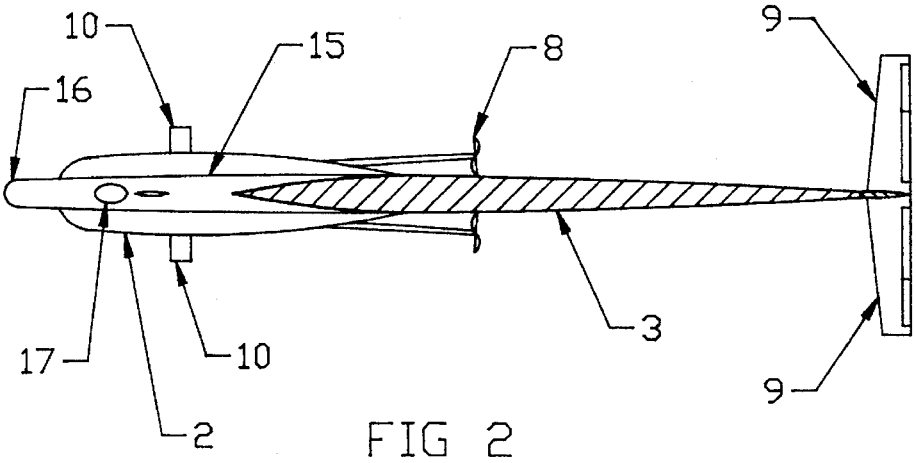

One of an important and useful new feature of present invention is that: since the center of lifting forces of the mainfoils and the center of buoyancy of the lower-hull is offset substantially along the longitudinal axis of the whole vessel system, it will create moment to incline the present vessel. This nature makes present water vessels so versatile and flexible that it can accommodate many different situations: from docking in a shallow harbor, to cruising at high speed in an open sea. In FIG. 1, when the vessel is cruising at high speed, the sub-hull 2 is buried deeply into water to improve propellent efficiency and to minimize wave making resistance. When the hydrodynamic center line of the sub-hull WLC is parallel with the horizontal water line WL2, it has the minimum water resistance. The upper hull H1 is foil borne, and is connected by the slender mainstrut 3, which also provides accesses to sub-hull. FIG. 2 shows the section view by the water line down to the sub-hull 2. It has a fish or airplane like body for minimizing water resistance. The longitudinal cross section of the mainstrut 3 shown with hatched lines in FIG. 2, is a slender body with knife-like edges for minimizing the crucial wave resistance. FIG. 3 shows the top view of the vessel above water line WL2. The decks 5 and the top of stabilizers 4 are the ideal platforms for military payload. The wave-piercing sharp bow visor 14 is designed for high speed capability.

The forces for lifting the upper hull H1 up from the water surface are provided by: the lifting forces of the mainfoils 9, and the net buoyancy of lower-hull. This is:

The net buoyancy of lower-hull =
(the buoyancy of lower-hull "B" (shown in FIG. 1))
minus (the gross weight of lower-hull) =
(the buoyancy of sub-hull and mainstrut)
minus (the gross weight of sub-hull and mainstrut).

It should be noted that the lower-hull buoyancy "B" shown in FIG. 1 is in "flying condition". It is different with the low-speed buoyancy. At low speed, the lifting force "L" is substituted by the upper hull buoyancy (not shown). The low-speed buoyancy is the lower-hull buoyancy plus the upper hull buoyancy.

Since the sub-hull 2, like a submarine, can be any size, the present water vessel system can be built to any size and weight. It does not have a tonnage limitation as the conventional hydrofoil crafts do.

The ratio of foil lift and lower-hull buoyancy (L)/(B) can be expressed as (S2)/(S1) (shown in FIG. 1). Its value depends on the application and size of a ship. The large vessel like the first embodiment shown in FIG. 1, which may be a liquid cargo tanker, the buoyancy portion can be larger than 80%. For a small vessel such as the second embodiment shown in FIG. 9, which may be a speed boat, the buoyancy portion can be less than 50%. In general, the larger the size or weight, the larger will be the buoyancy portion.

Figure 4:
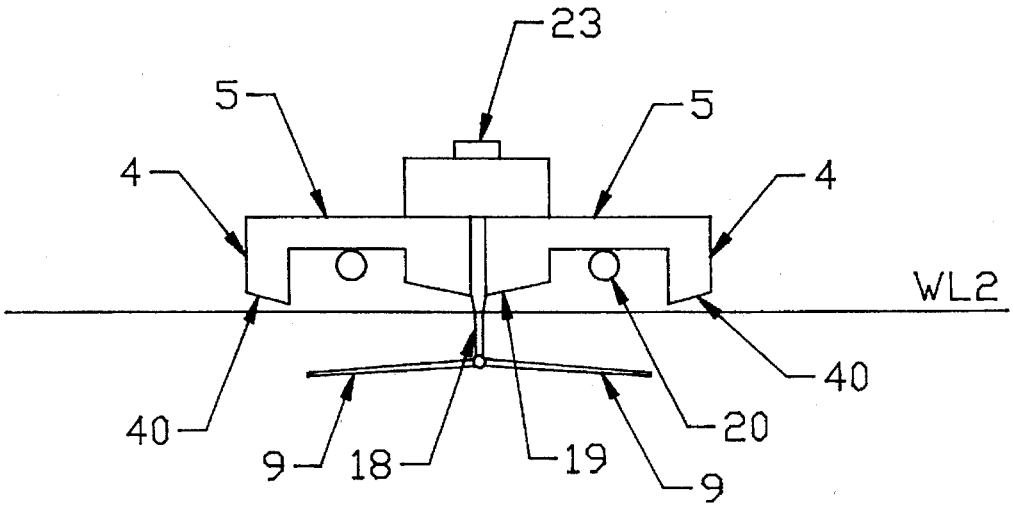

In stern view shown in FIG. 4, the mainfoils 9 have a long span for generating substantial lifting force and providing rolling control at high speed.

Figure 5:
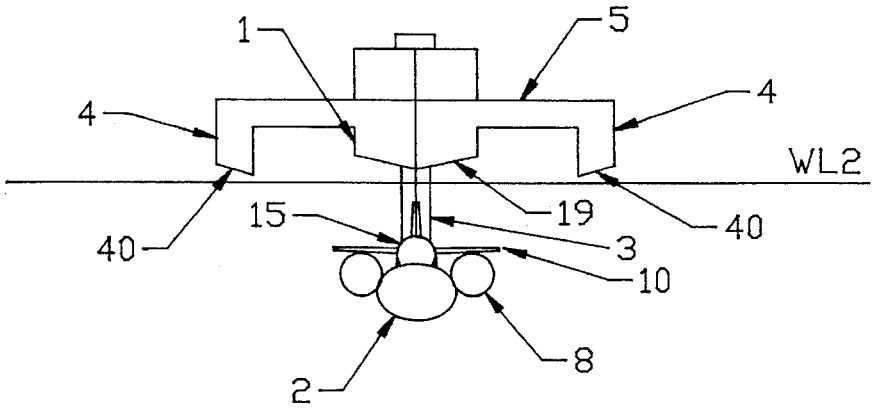

Shown in FIG. 5 is a bow view of FIG. 1. The V bottom 19 of the central body 1 and the bottom of stabilizers 40 are designed as dynamic planes for high speed operation and for an easy takeoff.

Figure 6:
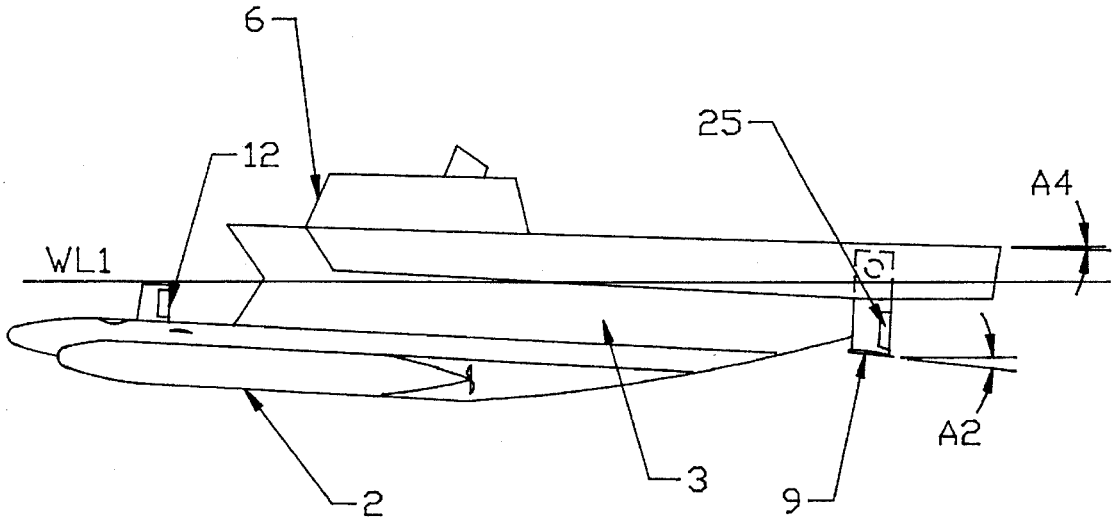

Refer to FIG. 1 and 6, when the speed of the vessel slows down slightly from FIG 1's condition, the lifting force L of the mainfoils 9 reduced. The stern portion of upper hull, and stabilizers 4 will be lowered and the angle of attack A2 (in FIG 6) of the mainfoils increased automatically. In turn, extra lift will be generated by the larger angle of attack A2, and compensating the reduced lifting force causing by the lost speed; therefore encouraging and keeping the upper hull H1 "flying". When the speed is slowed down further, the stern portion will finally touch down and stay on water surface as shown in FIG. 6.

At taking off, the process is reverse. The larger angle of attack A2 of the mainfoils shown in FIG. 6 creates more resistance (implying that it needs more power when taking off), but it also generates more lifting force. As speed increased, the lifting force L (shown in FIG. 1) of the mainfoils increases; in turn it will raise the stern section of the upper hull H1 (including stabilizers 4) higher, and create a moment S1 times L to press the sub-hull 2 down. Then by adjusting the angle of attack of the auxiliary foils 10, or by pumping out some ballast water from the sub-hull, or doing both, a lifting force B can be created to raise up the bow section. When the vessel reaching a suitable high speed, these two forces can raise the whole upper hull H1 up and hold above the water surface; and a flying equilibrium condition can be obtained. That is:

| | |
|---|---|
| Horizontal forces: | Water and air resistance forces = propellent force (not shown) |
| Vertical forces: | Gross weight of water vessel "P" = buoyancy of lower-hull "B" + lifting forces of mainfoils "L" (shown in FIG. 1) |
| Moments: | "L" times "S1" = "B" times "S2" (shown in FIG. 1) |

(In above, it is assumed that the moments created by air, water resistances and propellent forces are small and negligible.)

Figure 7:
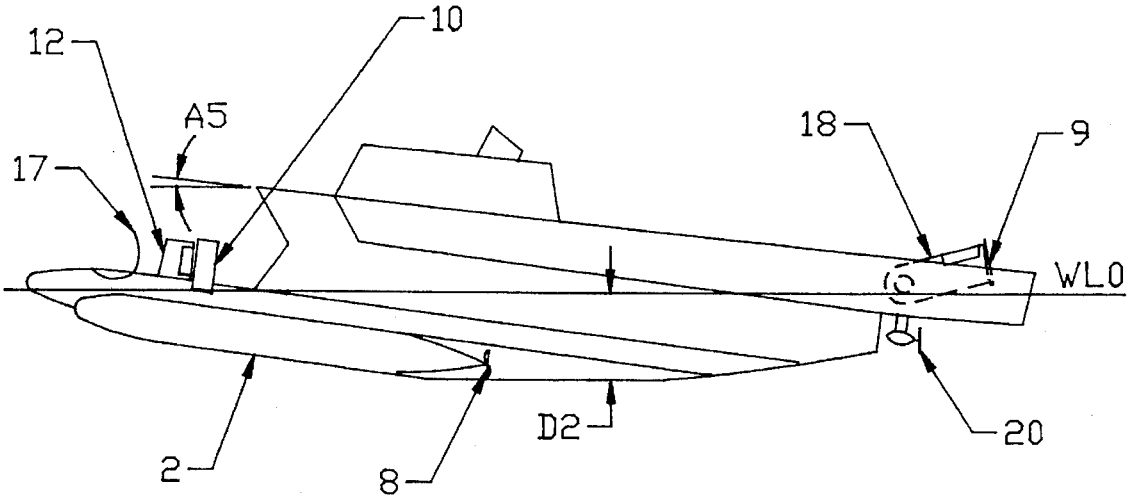

One of the advantages of the present embodiment is that: once the vessel reaching a constant design speed, the "flying" condition is pretty much inherently stable. If the upper hull was lowered, the angle of attack A1 (in FIG. 1) automatically increased; in turn, the lifting forces of the mainfoils 9 are automatically increased to lift the upper hull up. At the front section, if the sub-hull was lowered, the increased emerged volume in the bow mainstrut and bow central body 1 will generate extra buoyancy to lift it up, even though without the help of auxiliary foils 10. This character is more apparent for a ship having a long mainstrut and with a central body extended forward like the ship shown in FIG. 9. This property makes the water vessels of present embodiment very easy to control, comparing to the conventional hydrofoils and the hybrid hydrofoil craft described in Ref. 1. FIG. 7 shown in low speed, a pair of retractable, rotatable(steerable) auxiliary propellers 20 are lowered into water for pushing ahead, pulling back or making turns. This is a known technology and do not included in the present invention.

WL3 and D3 shown in FIG. 1 are the water level and the maximum draught when the present vessel is at low speed or at rest in a deep water. The D3 possibly is also the draught of the same size Ref. 1's craft needed at low speed. Utilizing said "Hull Inclination Method", by inclining the hull longitudinally, the vessels of present invention have a unique "draught reducing capability" not found in any type of current hydrofoil crafts. When operating in a shallow water, the draught of present water vessels can be reduced by pumping out ballast water (not shown) closer to the bow end, and raising up the deepest portion of the vessel system, which is at the bottom of said sub-hull. The minimum draught D2 (shown in FIG. 7) as at docking, is roughly 70% of the draught D1 as at high speed cruising, and is roughly 60% of the maximum draught D3 as at rest or at low speed in deep water. So the operational and maintenance costs of present vessel systems will be much less than the conventional fixed hydrofoils and the Ref. 1 hybrid hydrofoil vessels.

The present embodiment has two more advantages. First, like a submarine, the main propellers are located at the rear end of the sub-hull. This kind of structure is simpler, stronger and has better propellent efficient comparing to the conventional hydrofoil type crafts. Second, the mainfoils 9, auxiliary foils 10, and fore rudder 12 can be retracted or raised up from the water surface to avoid hitting the sea bed when docking. All these features reduce the operational and maintenance costs. The sub-door 17 (shown in FIG. 7) can be opened. This is an additional access to the sub-hull when docking.

In order to obtain the optimum diving draught D2 (shown in FIG. 1) or the minimum docking draught D2 (shown in FIG. 7), the water vessels of present invention may incline longitudinally forward or backward. Shown in FIG. 1 at high speed, the level of upper hull inclines slightly forward with a small angle A3. Shown in FIG. 7 at low speed or rest, it inclines backward with a larger angle A5. In general, the inclination should not be too big to affect the activities and operations on board. An automatic leveling system shall be installed to dinner tables, office desks, or the places whenever there is a necessity.

Figure 8:
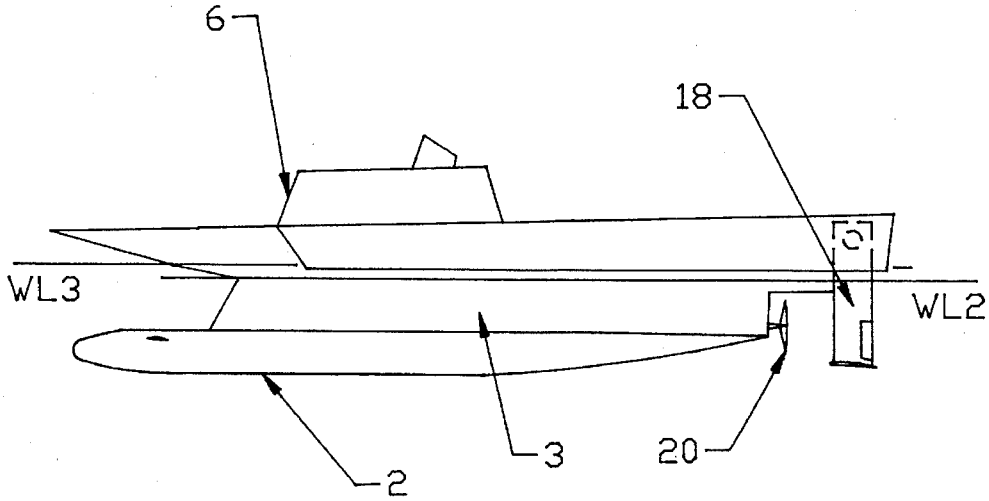

FIG. 8 shows an alternate design of the first embodiment. This ship has a single propeller located at the stern end of the mainstrut 3. The line WL3 shown in FIG. 8 represents the water level while the ship is operating with low speed or at rest in a deep water. Under this condition, water is pumped into ballast tanks (not shown) close to the bow end of the sub-hull; allowing the bottom of sub-hull 2, which is a rugged structure, to become the lowest portion of the vessel system, for protecting the propeller 20.

Figure 9:
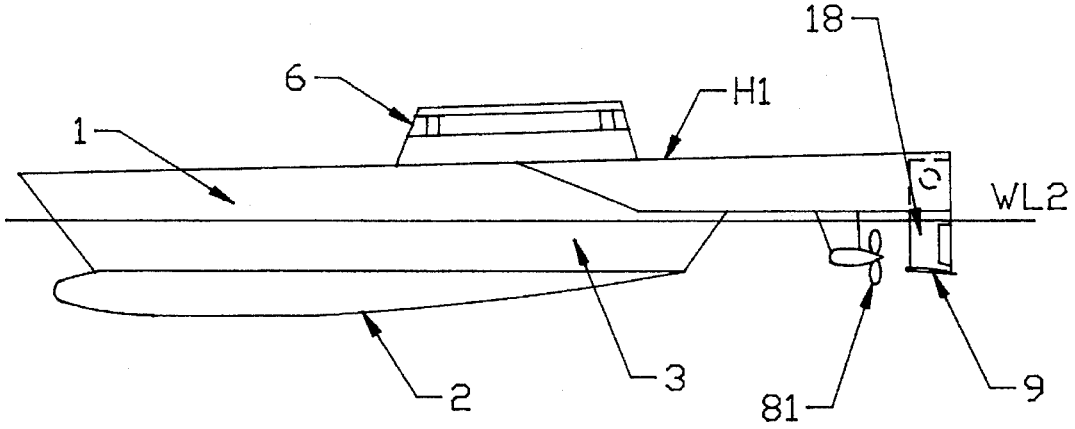
FIG. 9 is a side elevational view of the second embodiment, while the vessel is at high cruising speed.
Figure 10:
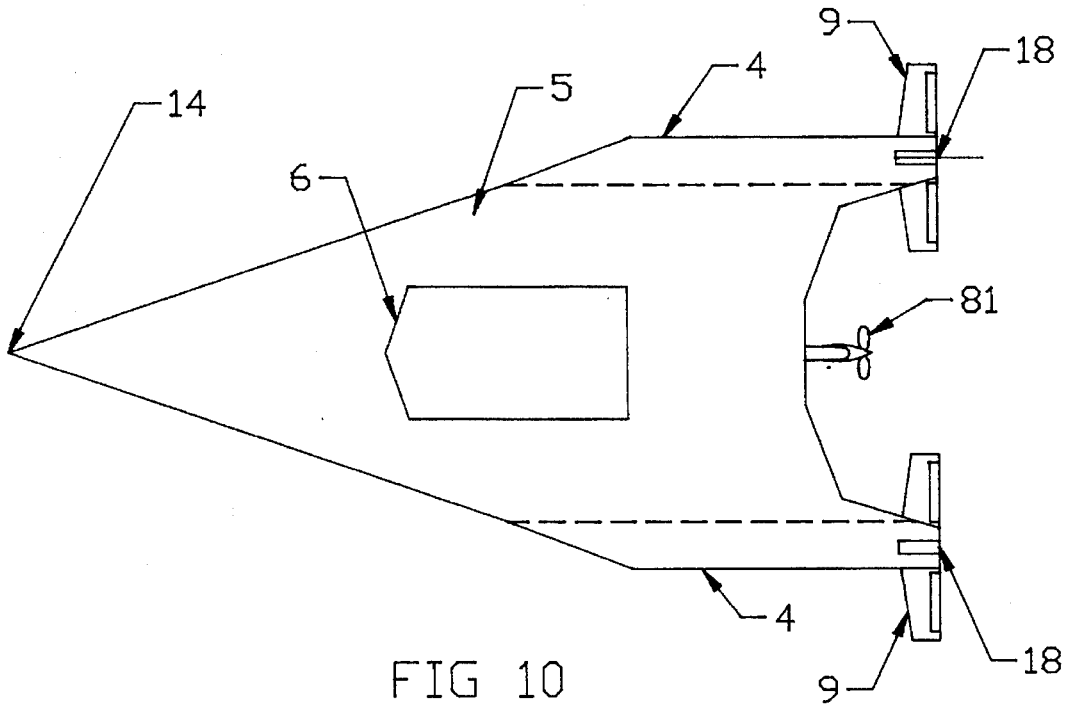
FIG. 10 is the top view of FIG. 9.

The second preferred embodiment, shown in FIG. 9 and FIG. 10, is a smaller craft. The auxiliary fore foil is eliminated. This craft uses a tiltable stern drive unit 81 and two pairs of retractable type mainfoils 9. The propeller and mainfoils can be tilted and retracted up for beaching or launching.

The location of mainfoils 9 and the stabilizers 4 may either be located at the stern end section of the hull as the first and second embodiments described, or at the bow end section of the hull like the third embodiment shown in FIG. 11 through FIG. 14.

The ship of the third preferred embodiment (see FIG. 11 through FIG. 14) of present invention is a derivation from a traditional slender hull ship (such as a rowing shell). It includes: an upper hull with a slender central body 1, wide decks 5 adapted for stabilizing, bridge 6 at the top of super structure, a ballast tank 24 at stern end, and a pair of mainfoils 9 with retractable strut 18 at bow end of upper hull H1. A somewhat sub-hull like structure has a much smaller pontoon (2), for housing power transmission means (not shown) and propellent means (vectored water jet 32), disposed at the stern end. The hole 31 is water inlet. Since the water jet is vectorlized, the stern rudder is eliminated. FIG. 12 is the top view of FIG. 11.

Figure 11:
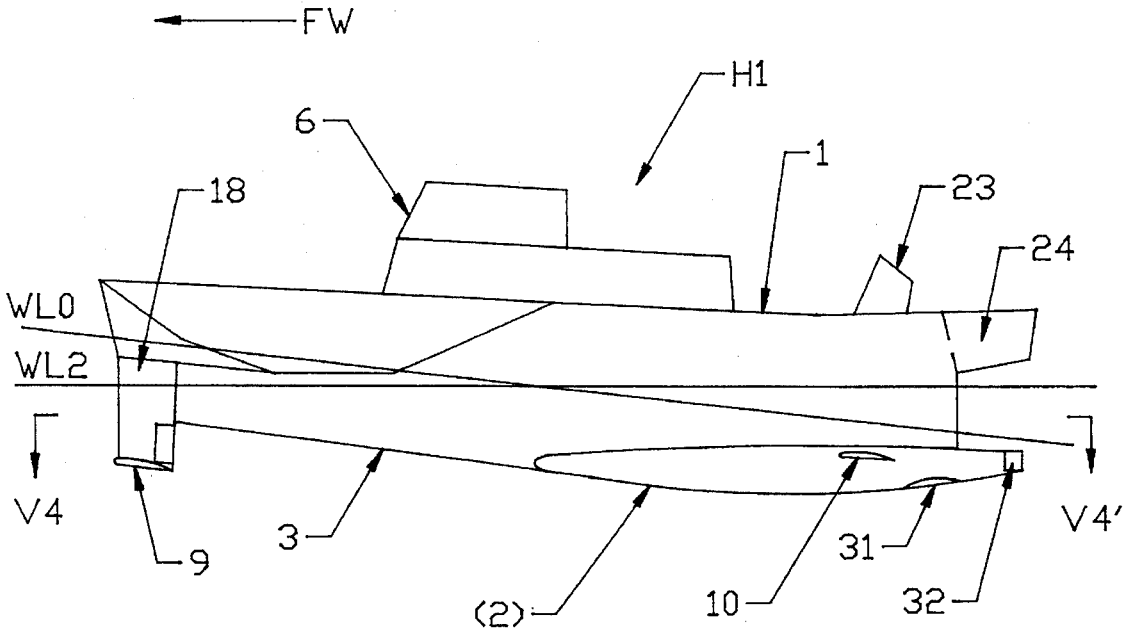
FIG. 11 through 14 are views of the third preferred embodiment.
Figure 12:
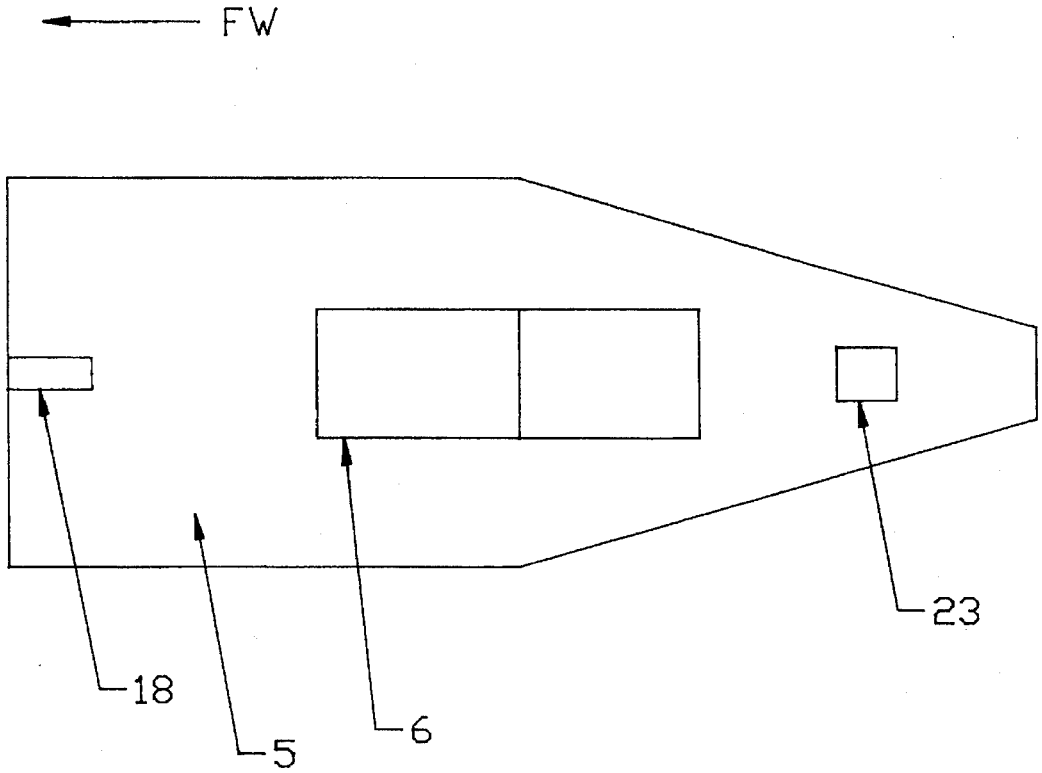
Figure 13:
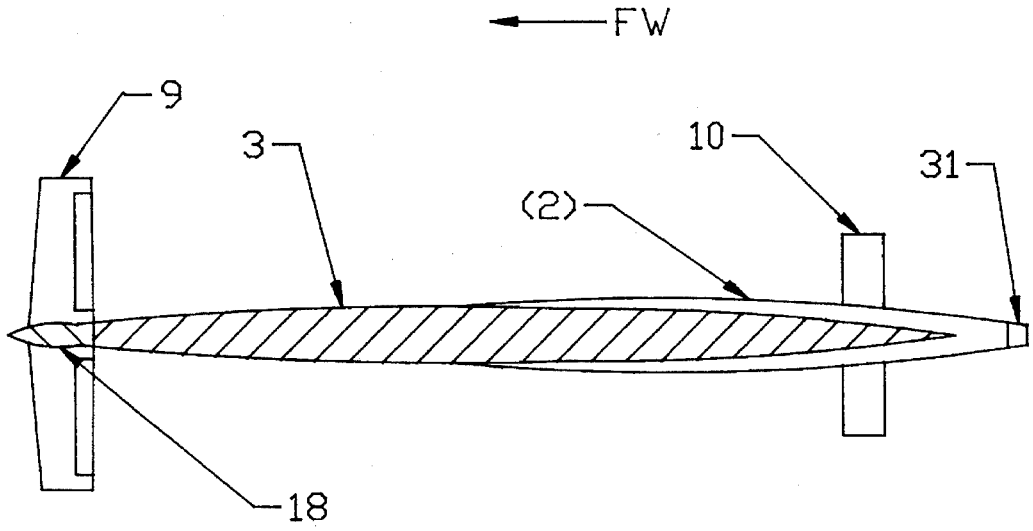

FIG. 13 is the section view along V4–V4' of FIG. 11, which shows the longitudinal cross section of the mainstrut 3 looked like a rowing shell. It provides substantial flotation.

FIG. 14 is the bow view of FIG. 11. It shows the bow view of present embodiment looked like a flying hydrofoil craft. The V bottoms 19 are planing surfaces, which help to raise up the bow section of the vessel from water surface while at high speed.

The line WLO shown in FIG. 11 is the water line at low speed. When taking off, in addition to increase the speed for generating more lifting forces of mainfoils 9 at bow end, ballast water is also pumped to the stern tank 24, for creating a moment to raise the bow section out of water. When operating at low speed in a shallow water, the ballast tank 24 should be emptied to allow the sub-hull 2 be raised up (as the line WLO shown in FIG. 11); and the mainfoils 9 should be retracted, to minimize the draught of whole vessel system.

FIG. 15 through FIG. 23 show the fourth preferred embodiment of present invention. The ship structure and the operational methods of this embodiment are similar to the first embodiment; except that the main propellent means 7 is reversible type and located at the bow end of the sub-hull and a backward steering means (including side thruster means 21) is adapted.

Figure 15:
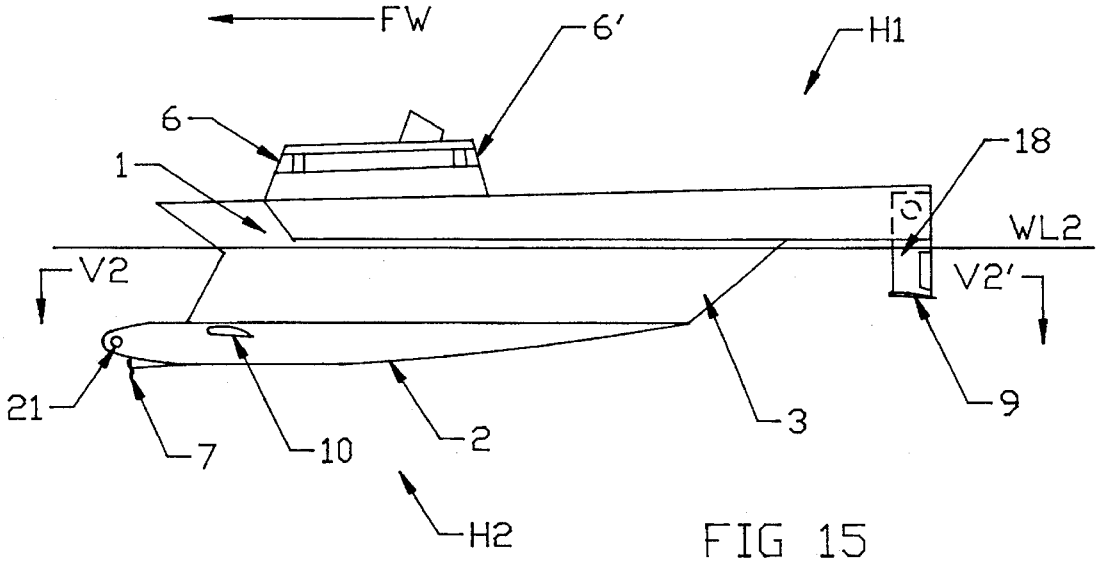
FIG. 15–23 are views of the fourth preferred embodiment.
Figure 16:
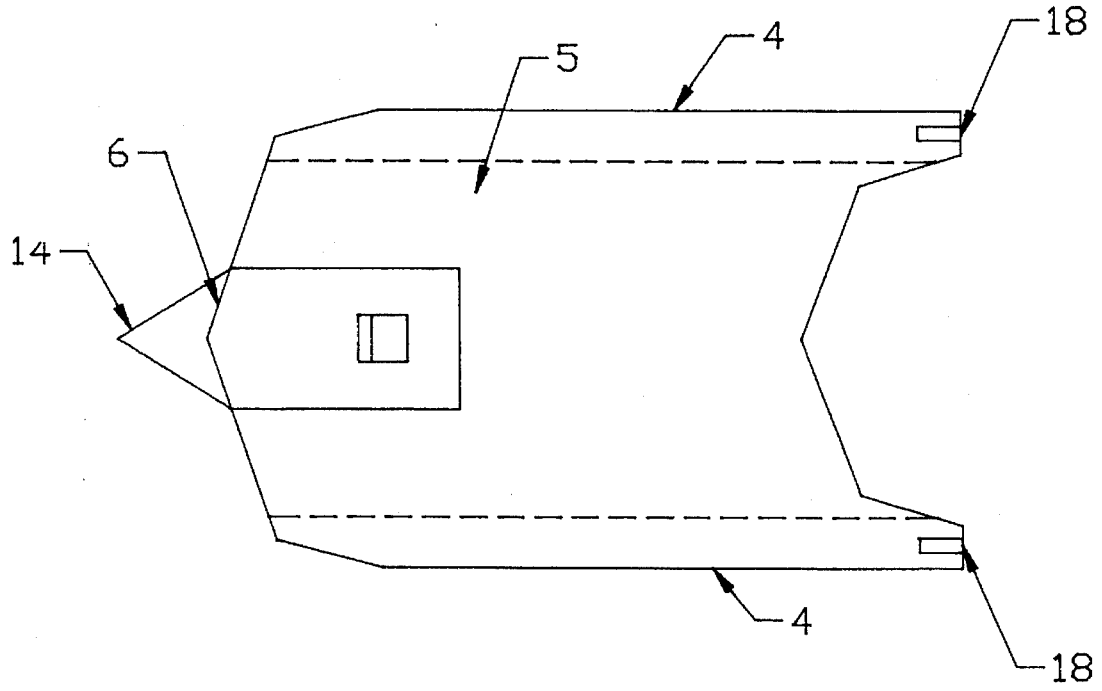
Figure 17:
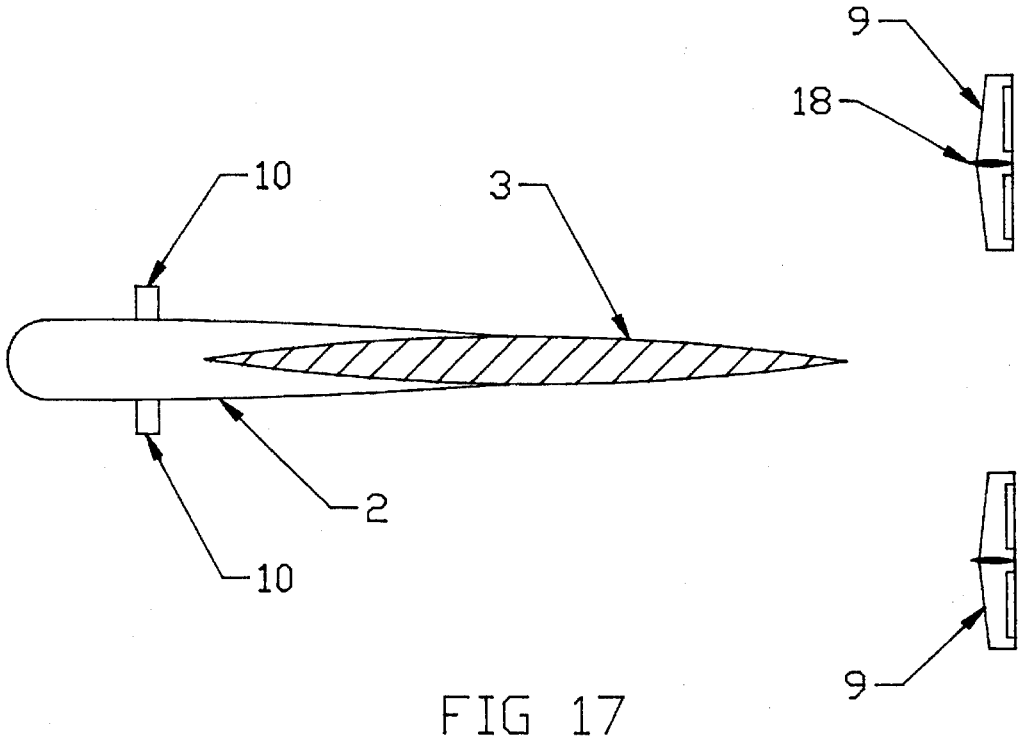

There are two advantages of mounting propellers to the bow end of a ship. First, there is no disturbing flow at the front of a ship. Second, when flying, as shown in FIG. 15, the vessel is inclined slightly forward, so that the bow end is at the deepest position of entire system. By mounting propeller at this place will minimize the "cavitation" phenomena at the low pressure side of blades of a propeller, and increase the propellent efficiency thereof.

Figure 18:
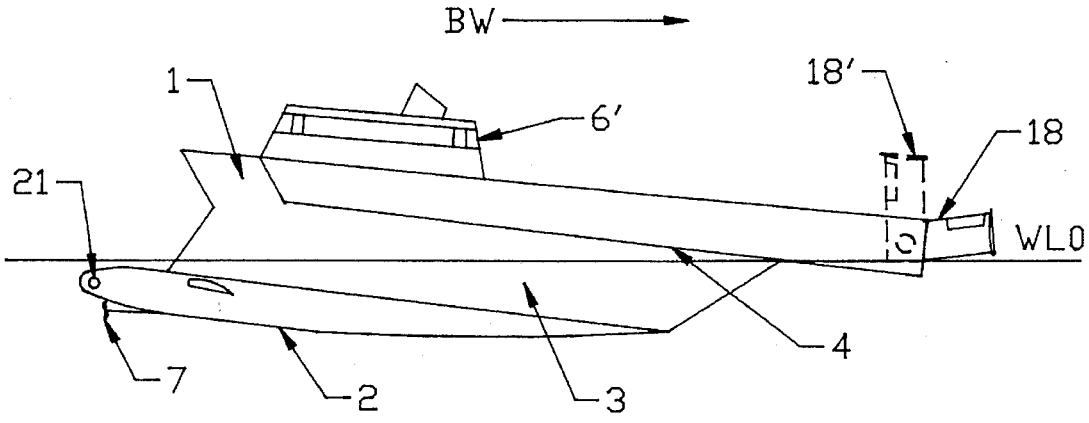

In order to avoid a serious damage to the fore propeller 7, the ship of this design should go backward when operating in a shallow water or harbor. A backward steering systems including a backward pilot-house 6' (shown in FIG. 15 and FIG. 18) is adapted. In FIG. 18, by reversing the angle of attack of the propeller 7 (or turning propeller the other way), the vessel is going backward (arrow BW shows the direction) with mainfoils 18 retracted horizontally. The propeller 7 is well protected by going backward. The side thruster 21 at the bow end is for making turns. The dotted lines 18' shown the mainfoils was retracted vertically for docking. The line WLO indicates the water line for shallow water operations.

Figure 19:
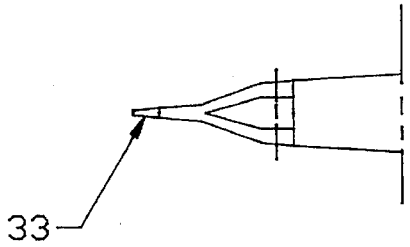
Figure 20:
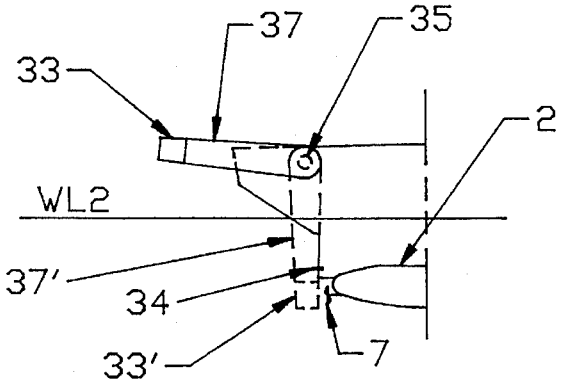

FIG. 19 and FIG. 20 illustrate an alternate design for bow propeller protection. A retractable bi-functional device, PP(propeller protector)/rudder 33, is placed at the bow end of the upper hull, and can be lowered down and locked with a lock pin 34 to the front edge of the mainstrut. The solid lines 33 in FIG. 19 and 20 shown the PP/rudder 33 is retracted for cruising at high speed in an open sea. Shown in FIG. 20, the PP/rudder (dotted lines 33') is lowered for providing primary protection to the propeller 7 when the vessel is going forward with low speed. The PP 33' is rotatable along the longitudinal axis of support bar 37'. It also functions as a rudder when the water vessel is in moving operations.

Figure 21:
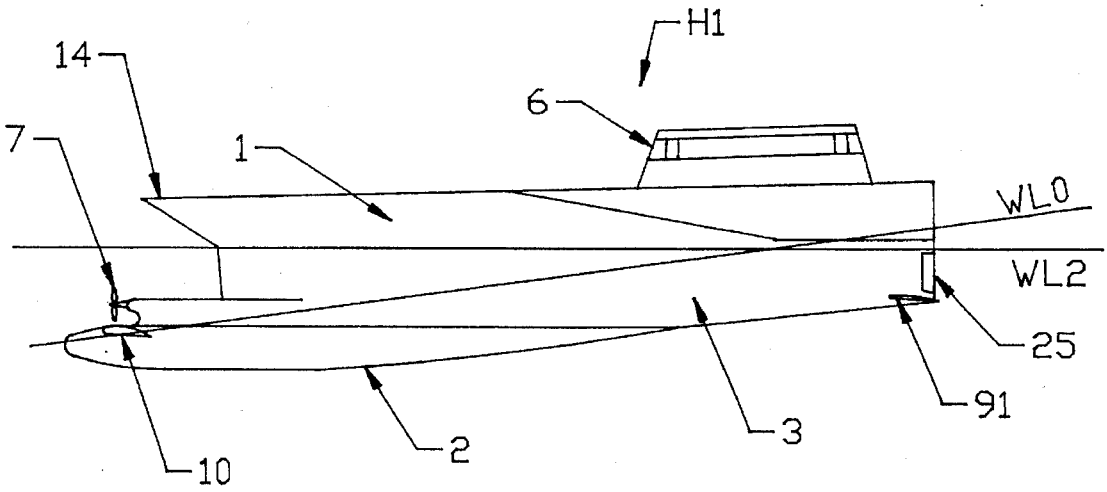
Figure 22:
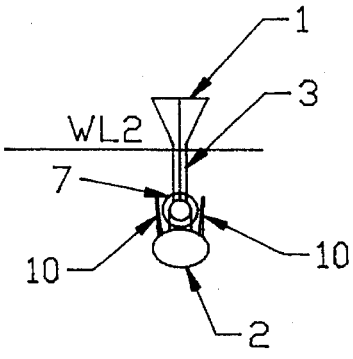
Figure 23:
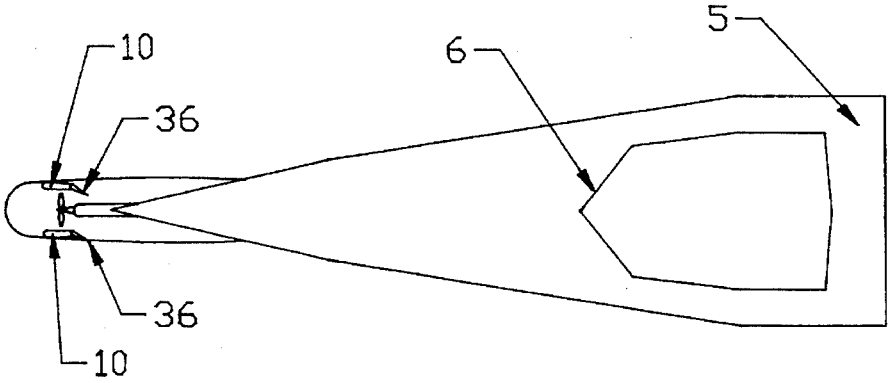

FIG. 21 to FIG. 23 illustrate another alternate design for providing fully protection to the fore propellent means. Shown in FIG. 21, a fore propellent means 7 is mounted on the top structure of the sub-hull 2, and the fore end of said sub-hull is extended over the front of the propellent means 7. In this design, the machinery such as motor, power transmission or impeller means (in case of using water jet) will be embedded into the fore end section of the sub-hull 2. An extra strong structure means is disposed at the end and bottom portions around the fore end of said sub-hull, for providing protection to said machinery means and fore propellent means. The auxiliary foils 10 are located by the sides of propeller 7. They can be rotated up vertically (shown in FIG. 22) to protect propeller 7 being damaged by floating debris. The backward steering system is not an absolutely necessary for this design, since the flaps 36 (shown in FIG. 23) can be turned to the same direction for manipulating said water vessel. Furthermore, by emptying the ballast tanks close to the propeller end, said water vessel will incline, and raise the propeller 7 above the water line WLO (in FIG. 21). This special feature provides a convenient access to the propellent and foil means for repairs or routine maintenance.

Other special features of this design are that the mainfoils 91 are the fixed and rugged type structures. The ship can be beached or launched without the delicate tilting or retracting means. This simple design is suitable for a low cost personal recreational speed boat.

Figure 24:
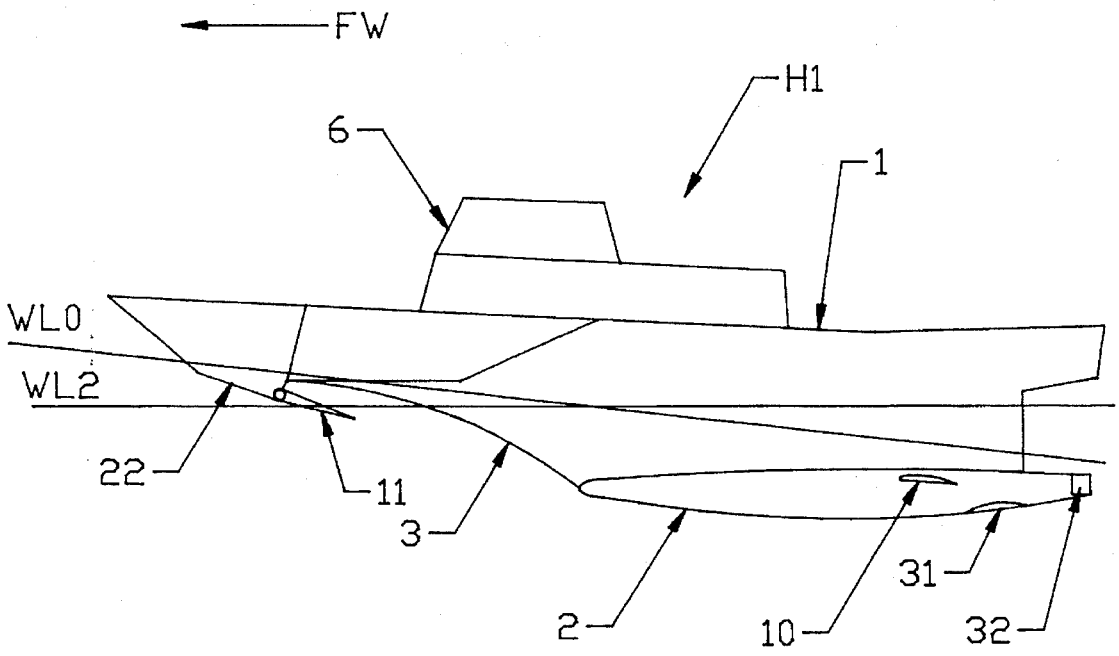
FIG. 24 is a side elevational view of fifth preferred embodiment of this invention when the vessel is at high cruising speed.
Figure 25:
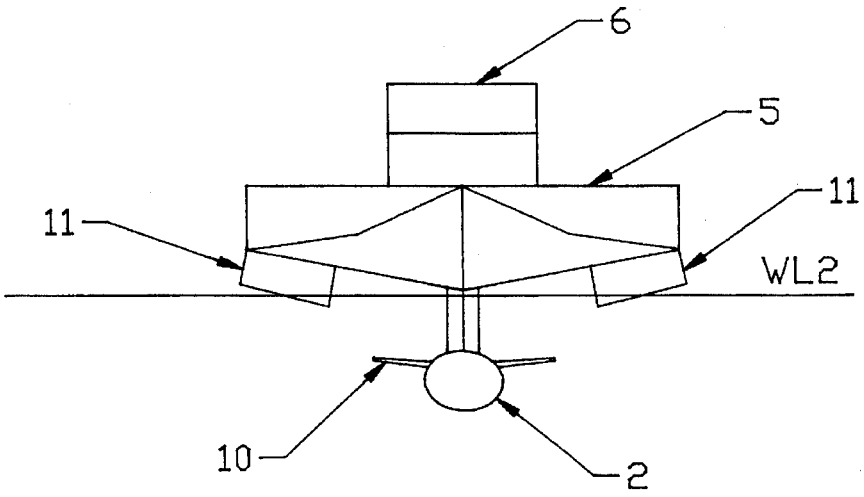
FIG. 25 is the bow view of FIG. 24.
Figure 26:
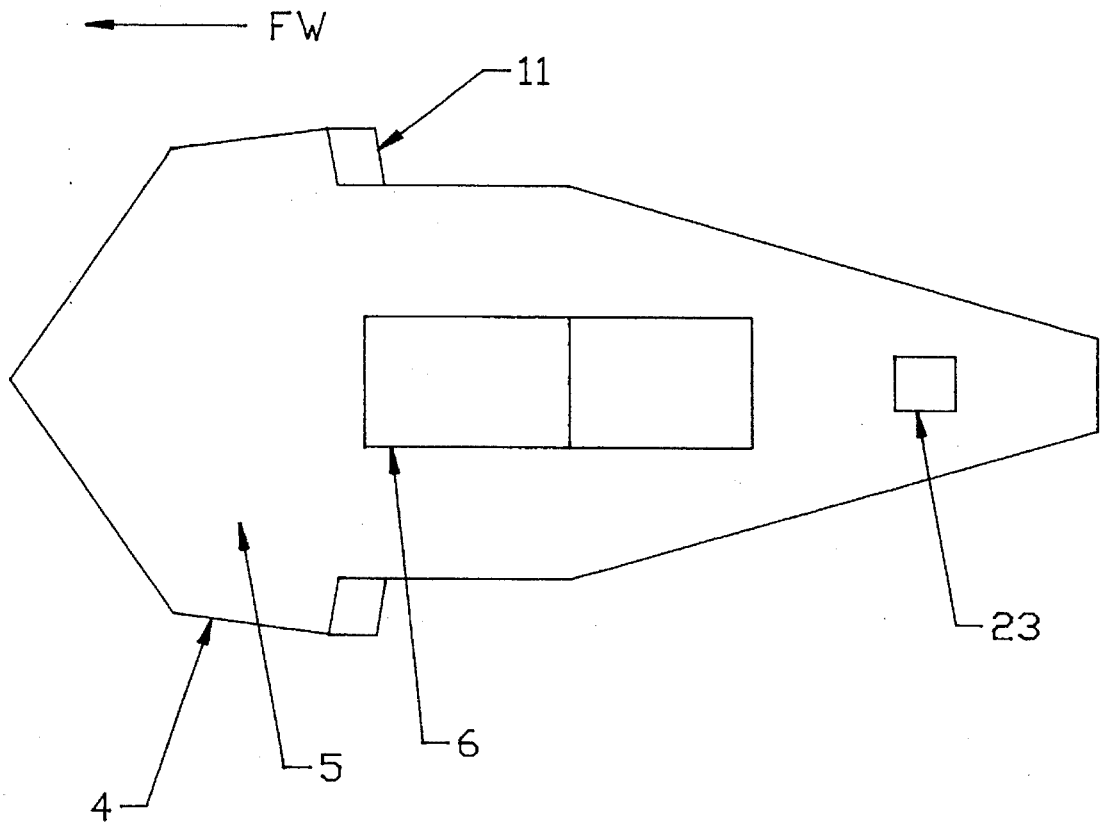
FIG. 26 is the top view of FIG. 24.
Figure 27:
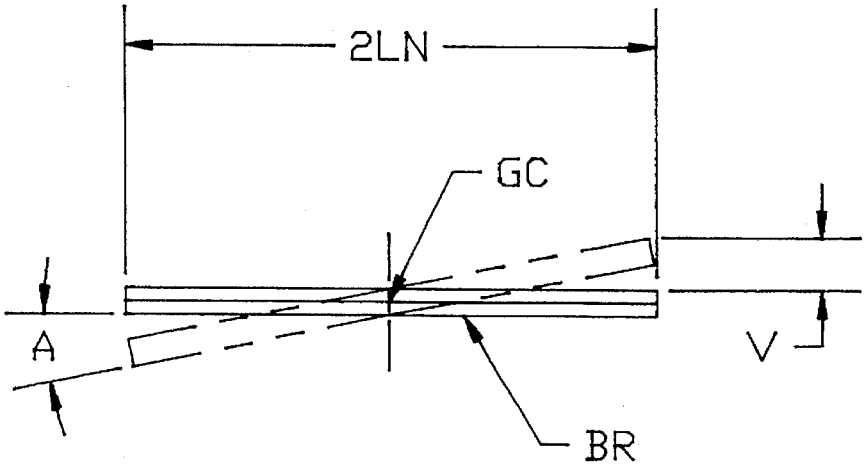
FIG. 27 and FIG. 28 are the drawings showing the "Inclined Bar Phenomenon".
Figure 28:
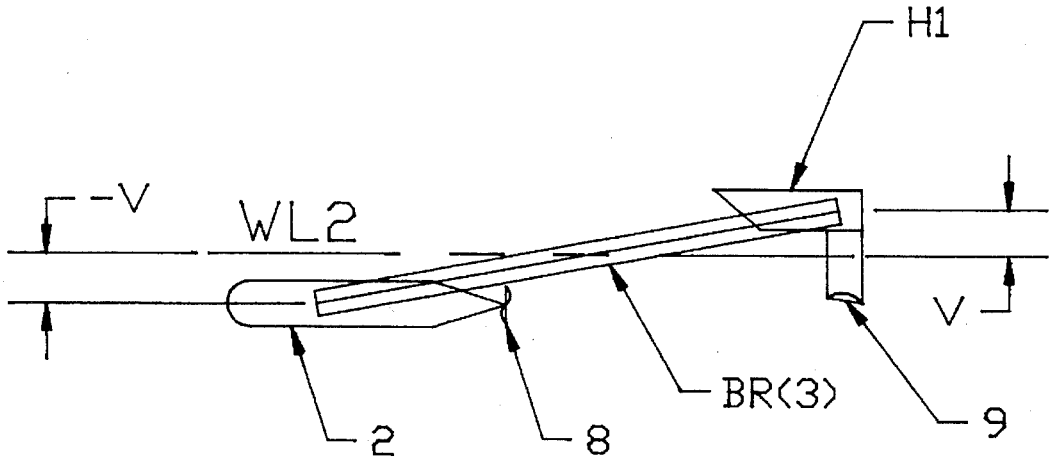

For a vessel normally operating in low wave conditions with high speed, the planing surface is another alternative means to generate hydrodynamic lifting force. Shown in FIG. 24 through FIG 26 is the fifth preferred embodiment of present invention. This vessel is a combination of a planing ship and a submarine. It utilizes planing surfaces 22 at the bottom of bow stabilizers 4 and has planing flaps 11 (shown in FIG. 25). The planing flaps 11 can raise up the bow section higher and improve the maneuverability of the vessel system. Shown in FIG. 26, the bow section is wide to stabilize the vessel at all speeds. The advantage of this type ship is that it has a simpler and stronger structure. It costs lower to build and maintain.

it should be noted that the propellers such as 8, 20(in FIG 7, first embodiment) and 7 (in FIG. 15 and FIG. 21, fourth embodiments) can be substituted by any other types of propellent means (such as water jet, magnetohydrodynamic system etc.) whenever they are available and adaptable.

I claim:

1. A water vessel comprising:

an upper hull having a wide stern section, said wide stern section providing substantial buoyancy to said water vessel when said water vessel is at low speed and at rest on the water surface;

a single, slender, lower-hull disposed beneath said upper hull for providing the primary flotation to said water vessel, said lower-hull's center of buoyancy being disposed forward to said water vessel's center of gravity, said lower-hull having high depth, narrow width at lateral cross sections; and at least a pair of mainfoil means disposed at a lower elevation than said upper hull and at a longitudinal position aft of the center of gravity of said water vessel, said mainfoil means being the primary support for said water vessel aft of said center of gravity when said water vessel is propelled over the water at a suitable high speed, said mainfoil means having a substantial distance to said lower-hull's center of buoyancy.

2. The water vessel of claim 1 wherein said lower-hull includes a bulb-headed, streamlined, generally torpedo shaped, buoyant sub-hull disposed beneath the bottom portion of said lower-hull for providing additional space and flotation to said lower-hull.

3. The water vessel of claim 2 which further comprises at least a pair of auxiliary hydrofoil means placed close to the fore end section of said lower-hull for providing substantial pitching control to said water vessel.

4. The water vessel of claim 2 which further comprises:

reversible fore propellent means for generating both forward and backward propellent forces to said water vessel, said reversible fore propellent means being located close to the fore end of said sub-hull;

hydrofoil retracting means adapted to said mainfoil means for retracting said mainfoil means; and a backward steering means which includes a means for generating sideward forces to steer and turn said water vessel when said water vessel is operating in a backward direction.

5. The water vessel of claim 2 which further comprises:

reversible fore propeller means for generating both forward and backward propellent force to said water vessel, said fore propeller means being located close to the fore end of said sub-hull means; and retractable propeller protector/rudder bi-functional means attached before said fore propeller means for steering said water vessel when said water vessel is going backward, and for protecting said fore propeller means when said water vessel is going forward.

6. The water vessel of claim 2 which further comprises:

strong bow structure means disposed at the end and bottom portions around the fore end of said sub-hull; and fore propellent means located after and on the top of said strong bow structure means, said fore propellent means being protected by said strong bow structure means when said water vessel is going forward.

7. The water vessel of claim 6 which further comprises:

a pair of vertically rotatable auxiliary hydrofoil means located by both sides of said fore propellent means, said auxiliary hydrofoil means providing further protection to said fore propellent means when said auxiliary hydrofoil means are rotated and stayed upward; and flap means attached to the rear edges of said auxiliary hydrofoil means for providing pitching control at high speed operation, and providing directional control when said water vessel is at low speed operation with said auxiliary hydrofoil means staying upward.

8. A water vessel comprising:

an upper hull having a wide bow section, said wide bow section providing substantial buoyancy to said water vessel when said water vessel is at low speed and at rest on the water;

a single, slender, lower-hull disposed beneath said upper hull for providing the primary flotation to said water vessel, said lower-hull's center of buoyancy being disposed backward of said water vessel's center of gravity, said lower-hull having high depth, narrow width at lateral cross sections;

planing surface means disposed at a lower elevation than said upper hull and at longitudinal position forward of the center of gravity of said water vessel, said planing surface means being the primary support for said water vessel forward of said center of gravity when said water vessel is propelled over the water at a suitable high speed, said planing surface means having a substantial distance to said lower-hull's center of buoyancy.

at least a pair of adjustable planing flap means extended backward from said planing surface means, for providing rolling control and substantial lifting support to said water vessel when said water vessel is propelled over the water surface at a suitable high speed.

* * * * *